US009498971B2

(12) United States Patent
Matsushima

(10) Patent No.: US 9,498,971 B2
(45) Date of Patent: Nov. 22, 2016

(54) INKJET PRINTING DEVICE

(71) Applicant: RISO KAGAKU CORPORATION, Tokyo (JP)

(72) Inventor: Isao Matsushima, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/853,212

(22) Filed: Sep. 14, 2015

(65) Prior Publication Data

US 2016/0082742 A1 Mar. 24, 2016

(30) Foreign Application Priority Data

Sep. 22, 2014 (JP) ..... 2014-192317

(51) Int. Cl.
*B41J 2/18* (2006.01)
*B41J 2/165* (2006.01)
*B41J 2/175* (2006.01)

(52) U.S. Cl.
CPC ..... *B41J 2/17566* (2013.01); *B41J 2/18* (2013.01)

(58) Field of Classification Search
CPC .. B41J 2/175; B41J 2/17506; B41J 2/17509; B41J 2/17566; B41J 2/17596; B41J 2/18; B41J 2/19; B41J 2/165; B41J 2202/07
See application file for complete search history.

(56) References Cited

U.S. PATENT DOCUMENTS 6,302,516 B1 * 10/2001 Brooks ..... B41J 2/175 347/35
2002/0024543 A1 * 2/2002 Kimura ..... B41J 2/17509 347/7
2004/0021725 A1 * 2/2004 McCarty ..... B41J 2/17509 347/29
2010/0194798 A1 * 8/2010 Asami ..... B41J 2/18 347/7

FOREIGN PATENT DOCUMENTS

JP 2012-153004 8/2012

* cited by examiner

*Primary Examiner* — Geoffrey Mruk
*Assistant Examiner* — Scott A Richmond
(74) *Attorney, Agent, or Firm* — Greenblum & Bernstein, P.L.C.

(57) ABSTRACT

A controller controls an ink liquid feeding operation performed by an ink pump from a negative pressure tank to a pressure tank, and an ink replenishing operation performed by an ink replenisher according to a liquid level in each of the pressure tank and the negative pressure tank so that, during purging, the liquid level in each of the pressure tank and the negative pressure tank is maintained at a reference level.

4 Claims, 3 Drawing Sheets

FIG. 2

| | | LIQUID LEVEL SENSOR FOR NEGATIVE PRESSURE TANK | |
|---|---|---|---|
| | | ON | OFF |
| LIQUID LEVEL SENSOR FOR PRESSURE TANK | ON | INK PUMP: OFF<br>INK REPLENISHING VALVE: CLOSE | INK PUMP: OFF<br>INK REPLENISHING VALVE: CLOSE |
| | OFF | INK PUMP: ON<br>INK REPLENISHING VALVE: CLOSE | INK PUMP: OFF<br>INK REPLENISHING VALVE: OPEN |

INKJET PRINTING DEVICE

BACKGROUND

1. Technical Field

The present invention relates to an ink-circulation type inkjet printing device.

2. Related Art

There are known ink-circulation type inkjet printing devices that eject ink from an inkjet head while circulating the ink, thereby performing printing.

One of the ink-circulation type inkjet printing devices is a device that applies positive pressure and negative pressure to a pressure tank disposed on the upstream side of the inkjet head and a negative pressure tank disposed on the downstream side thereof, respectively, thereby circulating the ink (see, for example, Patent Document 1).

The inkjet printing device described above uses an air pump to apply positive pressure and negative pressure to the pressure tank and the negative pressure tank, respectively, when performing printing. With this configuration, the ink flows from the pressure tank to the inkjet head. The ink that has not been consumed in the inkjet head is collected in the negative pressure tank. Then, the ink is fed from the negative pressure tank to the pressure tank with an ink pump. As described above, the ink is circulated.

Incidentally, in the inkjet printing device, the ink remaining in the nozzles of the inkjet head may be thickened during standby. This thickened ink may cause troubles in ink ejection such as disturbance of directions of ink ejected from nozzles and failure to eject ink. Furthermore, foreign substances such as dusts may be attached to the nozzles to cause another trouble in ink ejection.

To address these troubles, the inkjet printing device performs so-called purging of supplying pressurized ink from an ink supply source to the inkjet head to forcibly discharge the ink from the nozzles. Through the purging, thickened ink and the like are pushed out from the nozzles, thereby preventing the ejection troubles.

The pressure within the pressure tank is increased in the case where the purging is performed in the ink-circulation type inkjet printing device described above. With this configuration, the ink is supplied from the pressure tank to the inkjet head and the ink is forcibly discharged from the nozzles.

Patent Document 1: Japanese Patent Application Laid-Open Publication No. 2012-153004

SUMMARY

In the purging performed in the ink-circulation type inkjet printing device described above, the liquid level may largely reduce in the pressure tank due to flowing out of the ink from the pressure tank (for example, when the device is reactivated after a prolonged unused period of time). In such a case, after purging is performed, it is necessary to adjust the liquid level to make the liquid level in the pressure tank return to a state before the purging. This means that, in the case where printing is performed after purging, a time for adjusting the liquid level is required, which leads to occurrence of delay in starting printing.

The present invention has been made in view of the circumstances described above, and an object of the present invention is to provide an inkjet printing device that can prevent a delay in starting printing after purging.

In order to achieve the object described above, an inkjet printing device according to the present invention includes:

an inkjet head that includes a nozzle for ejecting ink;

a first tank that stores ink to be supplied to the inkjet head;

a second tank that receives ink not consumed in the inkjet head;

a circulation path for circulating ink among the first tank, the inkjet head, and the second tank;

an ink liquid feeder that feeds ink from the second tank to the first tank; an ink replenisher that replenishes ink in the second tank;

a purging unit that performs purging of supplying ink from the first tank to the inkjet head to discharge ink from the nozzle; and a controller that controls the purging unit to perform the purging, and controls an ink liquid feeding operation performed by the ink liquid feeder from the second tank to the first tank, and an ink replenishing operation performed by the ink replenisher according to a liquid level in each of the first tank and the second tank so that, during the purging, the liquid level in each of the first tank and the second tank is maintained at a reference level.

BRIEF DESCRIPTION OF DRAWINGS

FIG. 2 is an explanatory diagram of liquid-level maintaining control.

DETAILED DESCRIPTION

Hereinbelow, an embodiment according to the present invention will be described with reference to the drawings. The same or equivalent reference signs are attached to the same or equivalent portions or constituting elements throughout the drawings. However, it is noted that these drawings are schematically illustrated, and hence, are different from real ones. Furthermore, it is apparent that dimensional relationships or proportions of individual portions may vary according to drawings.

The embodiment to be described are illustrative to show specific devices or the like for implementing a technical concept according to the present invention. The technical concept of the present invention does not restrict materials, shapes, structures, arrangements or the like of constituting elements to those described below. The technical concept of the present invention can be modified in various manners within the scope of claims.

Figure 1:
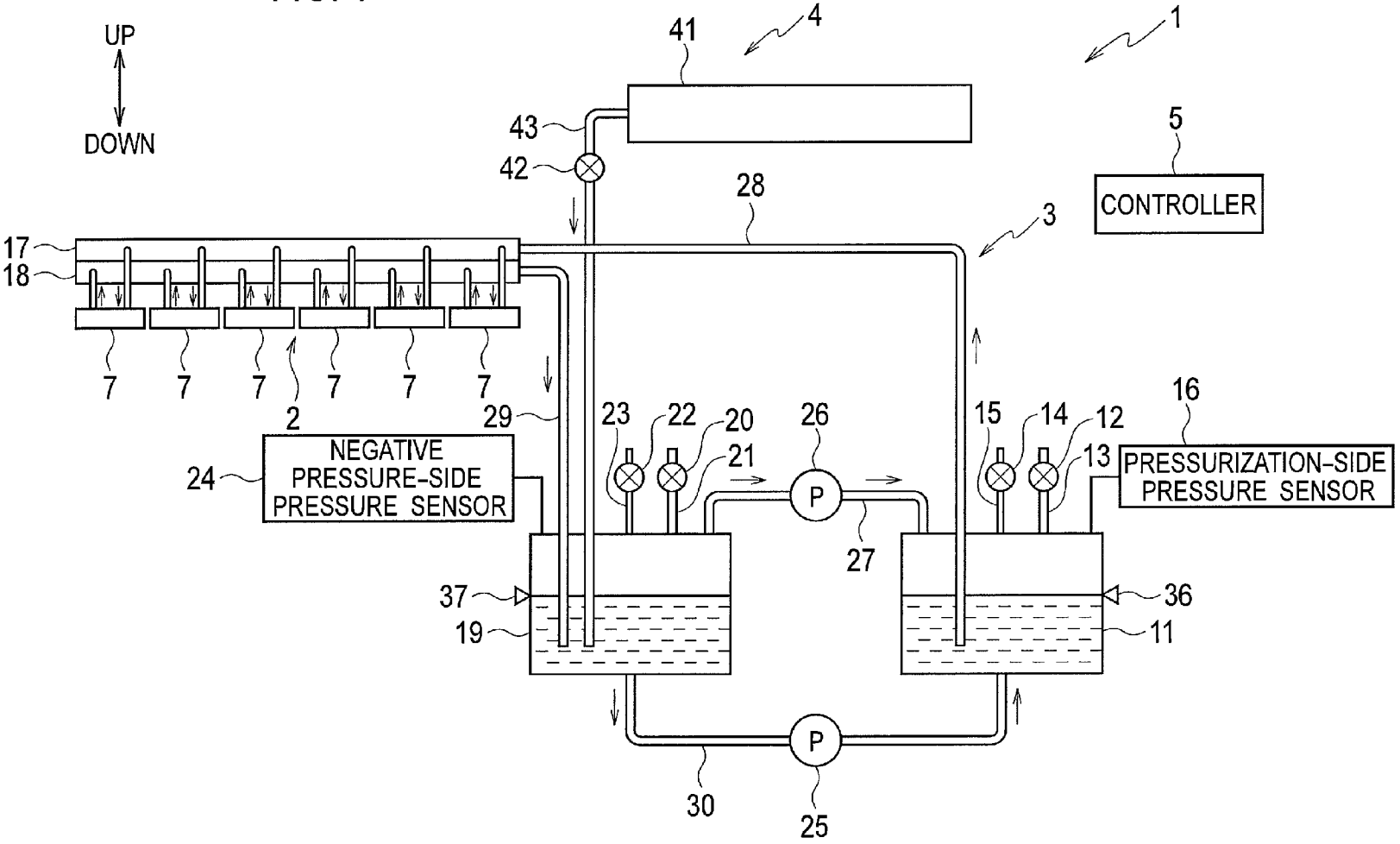
FIG. 1 is a schematic configuration diagram of an inkjet printing device according to an embodiment.

FIG. 1 is a schematic configuration diagram of an inkjet printing device according to an embodiment of the present invention. Note that, in the description below, the up-down direction represents a vertical direction, and the up-down direction of the inkjet printing device corresponds to up/down on the paper in FIG. 1.

As illustrated in FIG. 1, an inkjet printing device 1 according to this embodiment includes an inkjet head 2, an ink circulation unit 3, an ink replenisher 4 (corresponding to an ink replenisher), and a controller 5 (corresponding to a controller).

The inkjet head 2 ejects ink supplied by the ink circulation unit 3. The inkjet head 2 includes plural head modules 7.

Each of the head modules 7 includes an ink chamber (not illustrated) that stores the ink, and plural nozzles (not illustrated) for ejecting the ink. A piezoelectric element (not illustrated) is disposed within the ink chamber. The ink is ejected from the nozzles with drive of the piezoelectric element.

The ink circulation unit 3 supplies the ink to the inkjet head 2 while circulating the ink. The ink circulation unit 3 includes: a pressure tank 11 (corresponding to a first tank); an air release valve 12 for the pressure tank; an air release pipe 13 for the pressure tank; a pressure regulating valve 14 for the pressure tank; a pressure regulating pipe 15 for the pressure tank; a pressurization-side pressure sensor 16; an ink distributor 17; an ink collector 18; a negative pressure tank 19 (corresponding to a second tank); an air release valve 20 for the negative pressure tank; an air release pipe 21 for the negative pressure tank; a pressure regulating valve 22 for the negative pressure tank; a pressure regulating pipe 23 for the negative pressure tank; a negative pressure-side pressure sensor 24; an ink pump 25 (corresponding to an ink liquid feeder); an air pump 26; a pipe 27 for the air pump; and ink circulating pipes 28, 29, and 30.

The pressure tank 11 stores the ink to be supplied to the inkjet head 2. The ink in the pressure tank 11 is supplied to the inkjet head 2 through the ink circulating pipe 28 and the ink distributor 17. An air layer is formed above the liquid surface of the ink within the pressure tank 11. The pressure tank 11 is disposed at a position lower than (below) the inkjet head 2.

The pressure tank 11 includes a liquid level sensor 36 for the pressure tank. The liquid level sensor 36 for the pressure tank is used for detecting whether the liquid level of the ink within the pressure tank 11 reaches the reference level. The liquid level sensor 36 for the pressure tank outputs a signal indicating "ON" in the case where the liquid level of the ink within the pressure tank 11 is equal to or higher than the reference level, and outputs a signal indicating "OFF" in the case where the liquid level is lower than the reference level.

The air release valve 12 for the pressure tank opens or closes an air flow path within the air release pipe 13 for the pressure tank to switch the pressure tank 11 between a sealed state (a state of being sealed from the atmosphere) and a state of being opened to the atmosphere (a state of being communicated with the atmosphere). The air release valve 12 for the pressure tank is disposed at some midpoint of the air release pipe 13 for the pressure tank.

The air release pipe 13 for the pressure tank forms an air flow path for opening the pressure tank 11 to the atmosphere. The air release pipe 13 for the pressure tank has one end connected with the air layer within the pressure tank 11, and the other end communicated with the atmosphere.

The pressure regulating valve 14 for the pressure tank opens or closes an air flow path within the pressure regulating pipe 15 for the pressure tank to regulate the pressure within the pressure tank 11. The pressure regulating valve 14 for the pressure tank is disposed at some midpoint of the pressure regulating pipe 15 for the pressure tank.

The pressure regulating pipe 15 for the pressure tank forms an air flow path for regulating the pressure within the pressure tank 11. The pressure regulating pipe 15 for the pressure tank is formed by a pipe having a flow path resistance higher than the air release pipe 13 for the pressure tank. More specifically, the pressure regulating pipe 15 for the pressure tank is formed by a pipe narrower than the air release pipe 13 for the pressure tank. The pressure regulating pipe 15 for the pressure tank has one end connected with the air layer within the pressure tank 11, and the other end communicated with the atmosphere.

The pressurization-side pressure sensor 16 detects the pressure within the pressure tank 11.

The ink distributor 17 distributes the ink supplied from the pressure tank 11 through the ink circulating pipe 28, to each of the head modules 7 of the inkjet head 2.

The ink collector 18 collects the ink, which is not consumed in the inkjet head 2, from each of the head modules 7. The ink collected by the ink collector 18 flows to the negative pressure tank 19 through the ink circulating pipe 29.

The negative pressure tank 19 receives, from the ink collector 18, the ink, which is not consumed in the inkjet head 2, and stores it. Furthermore, the negative pressure tank 19 stores the ink supplied from an ink cartridge 41 of the ink replenisher 4, which will be described later. An air layer is formed above the liquid surface of the ink within the negative pressure tank 19. The negative pressure tank 19 is disposed at a height equal to that of the pressure tank 11.

The negative pressure tank 19 includes a liquid level sensor 37 for the negative pressure tank. The liquid level sensor 37 for the negative pressure tank is used for detecting whether the liquid level of the ink within the negative pressure tank 19 reaches the reference level. The liquid level sensor 37 for the negative pressure tank outputs a signal indicating "ON" in the case where the liquid level of the ink within the negative pressure tank 19 is equal to or higher than the reference level, and outputs a signal indicating "OFF" in the case where the liquid level is lower than the reference level.

The air release valve 20 for the negative pressure tank opens or closes an air flow path within the air release pipe 21 for the negative pressure tank to switch the negative pressure tank 19 between the sealed state and the state of being opened to the atmosphere. The air release valve 20 for the negative pressure tank is disposed at some midpoint of the air release pipe 21 for the negative pressure tank.

The air release pipe 21 for the negative pressure tank forms an air flow path used for opening the negative pressure tank 19 to the atmosphere. The air release pipe 21 for the negative pressure tank has one end connected with the air layer within the negative pressure tank 19, and the other end communicated with the atmosphere.

The pressure regulating valve 22 for the negative pressure tank opens or closes an air flow path within the pressure regulating pipe 23 for the negative pressure tank to regulate the pressure within the negative pressure tank 19. The pressure regulating valve 22 for the negative pressure tank is disposed at some midpoint of the pressure regulating pipe 23 for the negative pressure tank.

The pressure regulating pipe 23 for the negative pressure tank forms an air flow path used for regulating the pressure within the negative pressure tank 19. The pressure regulating pipe 23 for the negative pressure tank is formed by a pipe having a flow path resistance higher than the air release pipe 21 for the negative pressure tank. More specifically, the pressure regulating pipe 23 for the negative pressure tank is formed by a pipe having a diameter smaller than the air release pipe 21 for the negative pressure tank and approximately equal to the pressure regulating pipe 15 for the pressure tank. The pressure regulating pipe 23 for the negative pressure tank has one end connected with the air layer within the negative pressure tank 19, and the other end communicated with the atmosphere.

The negative pressure-side pressure sensor 24 detects the pressure within the negative pressure tank 19.

The ink pump 25 feeds the ink from the negative pressure tank 19 to the pressure tank 11. The ink pump 25 is disposed at some midpoint of the ink circulating pipe 30.

The air pump 26 feeds air from the negative pressure tank 19 to the pressure tank 11. The air pump 26 is disposed at some midpoint of the pipe 27 for the air pump.

Here, by closing the air release valve 12 for the pressure tank at the time of driving the air pump 26 to make the pressure tank 11 in the sealed state, pressure (positive pressure) is generated within the pressure tank 11. Furthermore, by closing the air release valve 20 for the negative pressure tank at the time of driving the air pump 26 to make the negative pressure tank 19 in the sealed state, pressure (negative pressure) is generated within the negative pressure tank 19. At the time of purging, the air pump 26 is driven to generate set pressures Pkp and Pfp for purging within the pressure tank 11 and the negative pressure tank 19, respectively, and the air release valve 12 for the pressure tank and the air release valve 20 for the negative pressure tank are closed. In other words, the air pump 26, the air release valve 12 for the pressure tank, and the air release valve 20 for the negative pressure tank form a purging unit. Purging is a process of supplying the ink from the pressure tank 11 to the inkjet head 2 to forcibly discharge the ink from the nozzles.

It should be noted that the set pressures Pkp and Pfp for purging described above represent a positive pressure within the pressure tank 11 and a negative pressure within the negative pressure tank 19, respectively, and indicate a difference from the atmospheric pressure. In other words, it is noted that, at the time of purging, pressure within the pressure tank 11 is expressed as "Patm+Pkp," and pressure within the negative pressure tank 19 is expressed as "Patm+Pfp," where Patm is the atmospheric pressure. Here, "Pkp>0>Pfp" holds.

The pipe 27 for the air pump forms a flow path for air fed by the air pump 26 from the negative pressure tank 19 to the pressure tank 11. The pipe 27 for the air pump has one end connected with the air layer within the negative pressure tank 19, and the other end communicated with the air layer within pressure tank 11.

The ink circulating pipe 28 connects the pressure tank 11 with the ink distributor 17. The ink flows in the ink circulating pipe 28 from the pressure tank 11 toward the ink distributor 17. The ink circulating pipe 29 connects the ink collector 18 with the negative pressure tank 19. The ink flows in the ink circulating pipe 29 from the ink collector 18 toward the negative pressure tank 19. The ink circulating pipe 30 connects the negative pressure tank 19 with the pressure tank 11. The ink flows in the ink circulating pipe 30 from the negative pressure tank 19 toward the pressure tank 11. The ink circulating pipes 28, 29, and 30, the ink distributor 17, and the ink collector 18 form a circulation path in which the ink circulates among the pressure tank 11, the inkjet head 2, and the negative pressure tank 19.

The ink replenisher 4 replenishes the ink in the negative pressure tank 19 of the ink circulation unit 3. The ink replenisher 4 includes the ink cartridge 41, an ink replenishing valve 42, and an ink replenishing pipe 43.

The ink cartridge 41 contains the ink used for printing performed by the inkjet head 2. The ink in the ink cartridge 41 is supplied through the ink replenishing pipe 43 to the negative pressure tank 19 of the ink circulation unit 3.

The ink replenishing valve 42 opens or closes a flow path for ink within the ink replenishing pipe 43. The ink replenishing valve 42 is opened at the time of replenishing the ink in the negative pressure tank 19.

The ink replenishing pipe 43 connects the ink cartridge 41 with the negative pressure tank 19. The ink flows in the ink replenishing pipe 43 from the ink cartridge 41 toward the negative pressure tank 19.

The controller 5 controls operations of each unit in the inkjet printing device 1. The controller 5 includes, for example, a CPU, a RAM, a ROM, and a hard disk.

The controller 5 causes the ink to be ejected from the inkjet head 2 to perform printing while causing the ink to circulate in the ink circulation unit 3. Furthermore, the controller 5 controls the air pump 26, the air release valve 12 for the pressure tank, and the air release valve 20 for the negative pressure tank at predetermined timings so as to perform purging. In addition, during purging, the controller 5 performs liquid-level maintaining control, which will be described later, so as to maintain the liquid level within each of the pressure tank 11 and the negative pressure tank 19 to be the reference level.

Next, operations performed by the inkjet printing device 1 at the time of printing will be described.

Once a printing job is inputted, the controller 5 first closes the air release valve 12 for the pressure tank and the air release valve 20 for the negative pressure tank. With this operation, the pressure tank 11 and the negative pressure tank 19 become the sealed state. Note that, during standby in which the inkjet printing device 1 is not in operation, the air release valve 12 for the pressure tank and the air release valve 20 for the negative pressure tank are opened, whereby the pressure tank 11 and the negative pressure tank 19 are opened to the atmosphere. Furthermore, during standby in which the inkjet printing device 1 is not in operation, the pressure regulating valve 14 for the pressure tank and the pressure regulating valve 22 for the negative pressure tank are closed.

Then, the controller 5 activates the air pump 26, whereby the pressure tank 11 starts to be pressurized whereas the negative pressure tank 19 starts to be decompressed. With these operations, a flow of the ink from the pressure tank 11 through the inkjet head 2 toward the negative pressure tank 19 is generated, whereby ink circulation starts. After the air pump 26 is activated, the controller 5 controls drive of the air pump 26, and open/close of the pressure regulating valve 14 for the pressure tank and the pressure regulating valve 22 for the negative pressure tank so that the pressures within the pressure tank 11 and the pressure within the negative pressure tank 19 become the set pressures Pk and Pf for circulation, respectively, and these set pressures Pk and Pf for circulation are maintained.

It should be noted that the set pressures Pk and Pf for circulation described above represent a positive pressure within the pressure tank 11 and a negative pressure within the negative pressure tank 19, respectively, and indicate a difference from the atmospheric pressure. In other words, it is noted that, under the circumstance where the ink circulation is maintained, pressure within the pressure tank 11 is expressed as "Patm+Pk," and pressure within the negative pressure tank 19 is expressed as "Patm+Pf." Here, "Pk>0>Pf" holds.

The set pressures Pk and Pf for circulation are set in advance as pressure values for making the nozzle pressure of the inkjet head 2 an appropriate value while circulating the ink. The set pressure Pk for circulation within the pressure tank 11 is a positive pressure, whereas the set pressure Pf for circulation within the negative pressure tank 19 is a negative pressure. The absolute value of the set pressure Pf for circulation within the negative pressure tank 19 is larger than that of the set pressure Pk for circulation within the pressure tank 11. With these settings, the nozzle pressure of the inkjet head 2 becomes a negative pressure suited to ink ejection.

After the pressure (positive pressure) within the pressure tank 11 and the pressure (negative pressure) within the negative pressure tank 19 become the set pressures Pk and Pf for circulation, respectively, the controller 5 controls the inkjet head 2 on the basis of a printing job to perform printing. During the printing job being performed, the ink is supplied from the pressure tank 11 to the inkjet head 2, and the ink that is not consumed in the inkjet head 2 is collected in the negative pressure tank 19.

When the ink circulation and printing are performed as described above, the controller 5 performs liquid-level maintaining control. In the liquid-level maintaining control, the ink pump 25 and the ink replenishing valve 42 are controlled according to the liquid levels within the pressure tank 11 and the negative pressure tank 19 so as to circulate the ink while maintaining the liquid levels within the pressure tank 11 and the negative pressure tank 19 at the reference level.

More specifically, as illustrated in FIG. 2, in the case where both of the liquid level sensor 36 for the pressure tank and the liquid level sensor 37 for the negative pressure tank indicate the ON state, the controller 5 causes the ink pump 25 to be OFF, and closes the ink replenishing valve 42.

In the case where the liquid level sensor 36 for the pressure tank indicates the ON state, and the liquid level sensor 37 for the negative pressure tank indicates the OFF state, the controller 5 also causes the ink pump 25 to be OFF, and closes the ink replenishing valve 42.

In the case where the liquid level sensor 36 for the pressure tank indicates the OFF state, and the liquid level sensor 37 for the negative pressure tank indicates the ON state, the controller 5 causes the ink pump 25 to be ON, and closes the ink replenishing valve 42.

In the case where both of the liquid level sensor 36 for the pressure tank and the liquid level sensor 37 for the negative pressure tank indicate the OFF state, the controller 5 causes the ink pump 25 to be OFF, and opens the ink replenishing valve 42.

In other words, if the liquid level sensor 36 for the pressure tank indicates the OFF state, and the liquid level sensor 37 for the negative pressure tank indicates the ON state, the ink pump 25 feeds the ink from the negative pressure tank 19 to the pressure tank 11 under the liquid-level maintaining control. On the other hand, if the liquid level sensor 36 for the pressure tank and the liquid level sensor 37 for the negative pressure tank both indicate the OFF state, the ink is replenished in the negative pressure tank 19 from the ink cartridge 41 under the liquid-level maintaining control. As described above, the liquid levels within the pressure tank 11 and the negative pressure tank 19 are maintained, and ink circulation and printing are performed.

Here, even if the liquid-level maintaining control is performed, the liquid levels within the pressure tank 11 and the negative pressure tank 19 may fluctuate according to hysteresis of ON/OFF with the liquid level sensor 36 for the pressure tank and the liquid level sensor 37 for the negative pressure tank. Furthermore, this fluctuation in the liquid surfaces causes a fluctuation in pressure within the pressure tank 11 and the negative pressure tank 19. The fluctuation in pressure within the pressure tank 11 and the negative pressure tank 19 leads to a fluctuation in nozzle pressure, which makes ink ejection unstable.

On the other hand, the controller 5 controls open/close of the pressure regulating valve 14 for the pressure tank and the pressure regulating valve 22 for the negative pressure tank, and drive of the air pump 26 on the basis of values detected by the pressurization-side pressure sensor 16 and the negative pressure-side pressure sensor 24, to make adjustment so as to prevent the fluctuation in pressure within the pressure tank 11 and the negative pressure tank 19.

Upon ending of the printing job, the controller 5 opens the air release valve 12 for the pressure tank and the air release valve 20 for the negative pressure tank. Here, in the case where the ink pump 25 and the air pump 26 are being driven, the controller 5 stops them. Furthermore, in the case where the pressure regulating valve 14 for the pressure tank, the pressure regulating valve 22 for the negative pressure tank, and the ink replenishing valve 42 are opened, the controller 5 closes these valves. With these operations, the ink circulation operation ends, and the inkjet printing device 1 becomes a standby state.

Next, operations performed by the inkjet printing device 1 at the time of purging will be described.

Figure 3:
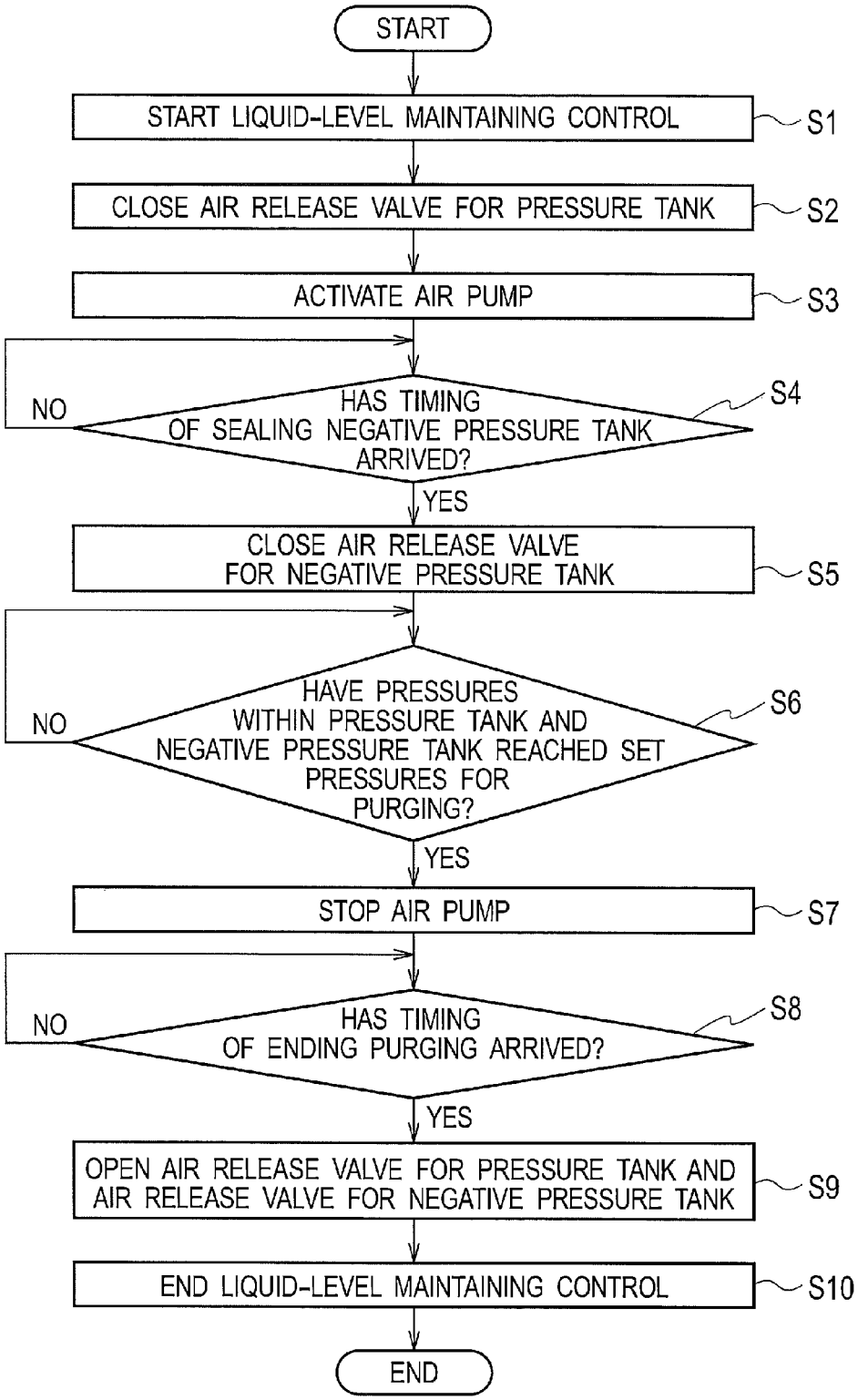
FIG. 3 is a flowchart for explaining operations performed at the time of purging.

FIG. 3 is a flowchart for explaining operations at the time of purging. The processing of the flowchart shown in FIG. 3 starts at the time when timing of purging arrives. The timing of purging is set, for example, on the basis of elapsed time since the end of the previous printing.

In step S1 in FIG. 3, the controller 5 starts the liquid-level maintaining control described above.

Then, in step S2, the controller 5 closes the air release valve 12 for the pressure tank. With this operation, the pressure tank 11 becomes the sealed state. Note that the air release valve 20 for the negative pressure tank is opened, and the pressure regulating valve 14 for the pressure tank and the pressure regulating valve 22 for the negative pressure tank are closed.

Then, in step S3, the controller 5 activates the air pump 26. With this operation, the pressure tank 11 starts to be pressurized.

Next, in step S4, the controller 5 judges whether the timing of sealing the negative pressure tank has arrived. The timing of sealing the negative pressure tank is set in advance as a timing of sealing the negative pressure tank 19 after the air pump 26 is activated.

At the timing of sealing the negative pressure tank, the pressure within the pressure tank 11 has not yet reached the set pressure Pkp for purging. The timing of sealing the negative pressure tank is set to be a time when the pressure (positive pressure) within the pressure tank 11 reaches a predetermined pressure lower than the set pressure Pkp for purging. The predetermined pressure described above is set so that, after the timing of sealing the negative pressure tank, the pressure tank 11 is pressurized with operation of the air pump 26, and the negative pressure tank 19 is decompressed, whereby the pressure (positive pressure) within the pressure tank 11 reaches the set pressure Pkp for purging and at the same time, the pressure (negative pressure) within the negative pressure tank 19 reaches the set pressure Pfp for purging.

The set pressure Pkp for purging within the pressure tank 11 and the set pressure Pfp for purging within the negative pressure tank 19 are set in advance as pressure values (a value of positive pressure and a value of negative pressure) for forcibly discharging the ink from the nozzles of the inkjet head 2 while circulating the ink. The set pressure Pkp for purging within the pressure tank 11 is larger than the absolute value of the set pressure Pfp for purging within the negative pressure tank 19.

If it is judged that the timing of sealing the negative pressure tank has not arrived (step S4: NO), the controller 5 repeats step S4.

If it is judged that the timing of sealing the negative pressure tank has arrived (step S4: YES), the controller 5 closes the air release valve 20 for the negative pressure tank in step S5. With this operation, the negative pressure tank 19 becomes the sealed state, and reduction in pressure starts.

Then, in step S6, the controller 5 judges whether the pressure (positive pressure) within the pressure tank 11 and the pressure (negative pressure) within the negative pressure tank 19 reach the set pressure Pkp, Pfp for purging, on the basis of the values detected by the pressurization-side pressure sensor 16 and the negative pressure-side pressure sensor 24. If it is judged that none of the pressure (positive pressure) within the pressure tank 11 and the pressure (negative pressure) within the negative pressure tank 19 reach the set pressure Pkp, Pfp for purging (step S6: NO), the controller 5 repeats step S6.

If it is judged that the pressure (positive pressure) within the pressure tank 11 and the pressure (negative pressure) within the negative pressure tank 19 both reach the set pressure Pkp, Pfp for purging (step S6: YES), the controller 5 stops the air pump 26 in step S7.

The set pressures Pkp and Pfp for purging are generated within the pressure tank 11 and the negative pressure tank 19 as described above, whereby the ink is supplied from the pressure tank 11 to the inkjet head 2 and the ink is forcibly discharged from the nozzles. Furthermore, under the liquid-level maintaining control, the ink is fed by the ink pump 25 to the pressure tank 11, and the ink is replenished in the negative pressure tank 19 by the ink replenisher 4, whereby the liquid levels within the pressure tank 11 and the negative pressure tank 19 are maintained at the reference levels.

Then, in step S8, the controller 5 judges whether the timing of ending purging has arrived. The timing of ending purging is set to be a time at which a predetermined period of time elapses since the air pump 26 stops. If it is judged that the timing of ending purging has not arrived (step S8: NO), the controller 5 repeats step S8.

If it is judges that the timing of ending purging has arrived (step S8: YES), the controller 5 opens, in step S9, the air release valve 12 for the pressure tank and the air release valve 20 for the negative pressure tank. Here, in the case where the ink pump 25 is being driven, the controller 5 stops the ink pump 25. Furthermore, in the case where the ink replenishing valve 42 is opened, the controller 5 closes the ink replenishing valve 42.

Next, in step S10, the controller 5 ends the liquid-level maintaining control. With this operation, a series of operations ends, and the inkjet printing device 1 becomes a standby state.

As described above, in the inkjet printing device 1, the controller 5 performs purging while performing the liquid-level maintaining control. More specifically, during purging, the controller 5 controls the ink liquid feeding operation by the ink pump 25 from the negative pressure tank 19 to the pressure tank 11 and the ink replenishing operation performed by the ink replenisher 4 according to the liquid levels within the pressure tank 11 and the negative pressure tank 19 so that the liquid levels within the pressure tank 11 and the negative pressure tank 19 are maintained at the reference levels. With these operations, the liquid levels within the pressure tank 11 and the negative pressure tank 19 are maintained at the reference levels after purging.

Here, unlike the present embodiment, the ink is not supplied to the pressure tank 11 during purging in the case where the liquid-level maintaining control is not performed during purging. Thus, in this case, the liquid level within the pressure tank 11 largely decreases from the reference level after purging. In order to make the liquid level return to the state before the purging, it is necessary to regulate the liquid level through control similar to the liquid-level maintaining control. More specifically, the controller 5 first operates the ink pump 25 until the liquid level sensor 36 for the pressure tank indicates ON. After this, the controller 5 opens the ink replenishing valve 42 until the liquid level sensor 37 for the negative pressure tank indicates ON. With this operation, the liquid levels within the pressure tank 11 and the negative pressure tank 19 become the reference levels, and return to the state before the purging. These processes lead to a delay in starting printing in the case where printing is performed after purging.

On the other hand, in the case of the inkjet printing device 1 according to this embodiment, the liquid levels within the pressure tank 11 and the negative pressure tank 19 are maintained at the reference levels after the purging, and hence, it is not necessary to regulate the liquid levels to make the liquid levels return to the state before the purging. This makes it possible to prevent a delay in starting printing after the purging.

Furthermore, with the inkjet printing device 1, when purging is performed, the pressure tank 11 is made into the sealed state, and pressurization is started. Then, the negative pressure tank 19 is made into the sealed state, and generation of negative pressure is started. With these operations, negative pressure occurs in the nozzles of the inkjet head 2, which makes it possible to prevent foreign substances such as dust from being taken in from the nozzles.

It should be noted that it may be possible to omit the generation of negative pressure within the negative pressure tank 19 at the time of purging. In such a case, with positive pressure applied to the pressure tank 11, it is possible to supply the ink from the pressure tank 11 to the inkjet head 2 to forcibly discharge the ink from the nozzles. Furthermore, by performing the liquid-level maintaining control, even after the purging, it is possible to maintain the state before purging.

Furthermore, the embodiment described above has the configuration in which one air pump 26 generates pressure within the pressure tank 11 and the negative pressure tank 19. However, it may be possible to employ a configuration in which pressure within the pressure tank 11 and pressure within the negative pressure tank 19 are generated separately using two air pumps.

The present invention is not limited to the embodiment described above, and it may be possible to carry out the present invention by variously modifying the constituting elements without departing from the main point of the present invention. Furthermore, various inventions may be formed by combining plural constituting elements disclosed in the embodiment described above as appropriate. For example, it may be possible to delete certain constituting elements from all the constituting elements described in the embodiment.

The present application claims priority based on Japanese Patent Application No. 2014-192317 filed on Sep. 22, 2014, the contents of which are incorporated herein by reference in their entirety.

INDUSTRIAL APPLICABILITY

According to the features of the inkjet printing device of the present invention, the controller controls the ink liquid feeding operation performed by the ink liquid feeder and the ink replenishing operation performed by the ink replenisher according to the liquid levels within the first tank and the second tank so that, during purging, the liquid levels within the first tank and the second tank are maintained at the reference levels. With this control, the liquid levels of the first tank and the second tank are maintained at the reference levels after the purging, and hence, it is not necessary to regulate the liquid level so as to return to the state before the purging. Thus, it is possible to prevent a delay in starting printing after the purging.

What is claimed is:

1. An inkjet printing device, comprising:

an inkjet head that includes a nozzle for ejecting ink;

a first tank that stores ink to be supplied to the inkjet head;

a second tank that receives ink not consumed in the inkjet head;

a circulation path for circulating ink among the first tank, the inkjet head, and the second tank;

an ink liquid feeder that feeds ink from the second tank to the first tank;

an ink replenisher that replenishes ink in the second tank;

a purging unit that performs purging of supplying ink from the first tank to the inkjet head to discharge ink from the nozzle; and a controller that controls the purging unit to perform the purging, and controls an ink liquid feeding operation performed by the ink liquid feeder from the second tank to the first tank, and an ink replenishing operation performed by the ink replenisher according to a liquid level in each of the first tank and the second tank so that, during the purging, the liquid level in each of the first tank and the second tank is maintained at a reference level.

2. The inkjet printing device according to claim 1, further comprising:

a first release valve which is configured to seal the first tank in a sealed state when the first release valve is closed, and unseal the first tank in a state of being opened to atmosphere when the first release valve is opened, and a second release valve which is configured to seal the second tank in a sealed state when the second release valve is closed, and unseal the second tank in a state of being opened to atmosphere when the second release valve is opened, wherein the first tank and the second tank are disposed at a same height in a vertical direction, and the first release valve is closed and the second release valve is opened during the purging.

3. The inkjet printing device according to claim 2, further comprising:

a positive pressure unit configured to generate positive pressure within the first tank, a negative pressure unit configured to generate negative pressure within the second tank, wherein when the purging is performed, negative pressure within the second tank is generated by closing the second release valve after generating positive pressure within the first tank by closing the first valve, and the second release valve is opened after generating negative pressure within the second tank.

4. The inkjet printing device according to claim 3, wherein a single air pump is configured as the positive pressure unit and the negative pressure unit, and the air pump is disposed at a pipe connecting an air layer within the first tank and an air layer within the second tank.

* * * * *